US005221604A

United States Patent [19]

Mifune et al.

[11] Patent Number: 5,221,604

[45] Date of Patent: Jun. 22, 1993

[54] SILVER HALIDE PHOTOGRAPHIC MATERIAL

[75] Inventors: Hiroyuki Mifune; Hiroyuki Asanuma, both of Kanagawa, Japan

[73] Assignee: Fuji Photo Film Co., Ltd., Kanagawa, Japan

[21] Appl. No.: 704,251

[22] Filed: May 22, 1991

[30] Foreign Application Priority Data

May 22, 1990 [JP] Japan ..... 2-131735

[51] Int. Cl.[5] ..... G03C 1/08

[52] U.S. Cl. ..... 430/604; 430/569; 430/577; 430/581; 430/607; 430/608; 430/611; 430/612

[58] Field of Search ..... 430/604, 569, 607, 611, 430/612, 608, 581, 577

[56] References Cited

U.S. PATENT DOCUMENTS 2,839,405 6/1958 Jones ..... 430/608
4,477,561 10/1984 Menjo et al. ..... 430/604
5,015,567 5/1991 Suga et al. ..... 430/569
5,051,344 9/1991 Kuno ..... 430/604
5,118,600 6/1992 Yamada et al. ..... 430/569

FOREIGN PATENT DOCUMENTS 1214982 12/1970 United Kingdom ..... 430/612

*Primary Examiner*—Charles L. Bowers, Jr.
*Assistant Examiner*—Thorl Chea
*Attorney, Agent, or Firm*—Sughrue, Mion, Zinn, Macpeak & Seas

[57] ABSTRACT

A silver halide photographic material comprising a support having thereon at least one silver halide emulsion layer wherein the silver halide emulsion contains a salt of a metal ion of which the atomic number is at least 21 alone or together with a chelating agent and wherein the silver halide emulsion has been chemically sensitized in the presence of a chemical sensitization promoter comprising at least one of a silver halide solvent and an adsorbable compound.

17 Claims, No Drawings

SILVER HALIDE PHOTOGRAPHIC MATERIAL

FIELD OF THE INVENTION

This invention concerns silver halide photographic photosensitive materials; and, in particular, it concerns silver halide photographic photosensitive materials which have an improved dye adsorbing capacity, or silver halide photographic photosensitive materials which have improved storage properties.

BACKGROUND OF THE INVENTION

The silver halides employed in silver halide photographic photosensitive materials are generally chemically sensitized to obtain a desired photographic speed and gradation, etc.

Known chemical sensitization methods include sulfur sensitization using active gelatin or compounds which contain sulfur that reacts with silver ions, selenium sensitization using selenium compounds, reduction sensitization using reducing substances and precious metal sensitization using gold or other precious metal compounds. These methods may be employed either individually or in combination.

Thiosulfate, thioureas, thiazoles, rhodanines and other compounds can be used as sulfur sensitizing agents; selenoureas and colloidal Se, for example, can be used as selenium sensitizing agents; stannous salts, amines, hydrazine derivatives, formamidinesulfinic acid and silane compounds, for example, can be used as reduction sensitizing agents; and, as complex salts of metals of group VIII of the periodic table ("the periodic table" based on herein is "PERIODIC CHART OF THE ELEMENTS" in *The Merck Index*, inside front cover, published by Merck & Co., Inc., 1989), such as platinum, iridium and palladium, for example, as well as gold complex salts, can be used for precious metal sensitization purposes.

Reference can be made, for example, to *Research Disclosure* volume 307, page 866 (1989) for actual examples of these chemical sensitizing agents, and they are well known to those in the industry.

Moreover, chemical sensitization promoters are used conjointly with the addition of these well known chemical sensitizing agents to inhibit fogging and increase photographic speed. Specific examples of such promoters which can be used include: compounds which are referred to as silver halide solvents, such as thiocyanate (for example, potassium thiocyanate, ammonium thiocyanate); thioether compounds (for example, the compounds disclosed in U.S. Pat. Nos. 3,021,215 and 4,276,374) and thione compounds (for example, the compounds disclosed in JP-B-59-11892, JP-B-60-11341 and U.S. Pat. No. 4,221,863); adsorbable compounds which can bond with silver ions at a nitrogen atom and form complex salts such as the azaindenes (for example, 4-hydroxy-6-methyl-1,3, 3a,7-tetraazaindene), azapyridazines, azapyrimidines and purines (for example, adenine) disclosed in the aforementioned *Research Disclosure* volume 307, page 866 (1989); and, the adsorbable compounds in which a mercapto group that bonds with silver ions is substituted in a heterocyclic ring, such as the mercaptoazoles, typified by the mercaptotetrazoles and mercaptotriazoles disclosed in *Research Disclosure* volume 307, page 869 (1989). (The term "JP-B" as used herein signifies an "examined Japanese patent publication".)

However, these chemical sensitization promoters are often cause various adverse effects. Thus, when a silver halide solvent is used, and especially when it is used in large amounts, a high photographic speed and reduced fogging are certainly obtained immediately after the completion of chemical sensitization; but, there is a pronounced decrease in the photographic speed on ageing, and the level of fogging increases. This deterioration in performance is especially pronounced when sensitizing dyes are also present.

Furthermore, the use of adsorbable compounds can result in pronounced inhibition of the adsorption of sensitizing dyes.

The presence of these chemical sensitization promoters is necessary during chemical sensitization, but their presence results in adverse effects if they remain in the silver halide emulsion after the completion of chemical sensitization, and these effects are especially pronounced when color sensitization is carried out.

Hence, the development of a method of inhibiting the action of these chemical sensitization promoters after the completion of chemical sensitization is desirable.

SUMMARY OF THE INVENTION

The general aim of the present invention is to provide silver halide photographic photosensitive materials which have improved dye adsorbing properties or silver halide photographic photosensitive materials which have improved storage properties.

The above and other objects and advantages of the present invention are attained by (1) a silver halide photographic emulsion undergone chemical sensitization in the presence of a chemical sensitization promoter comprising a silver halide solvent and/or an adsorbable compound, wherein said photographic emulsion has been treated to inhibit the action of said chemical sensitization promoter after said chemical sensitization and (2) a silver halide photographic material comprising a support having thereon at least one silver halide emulsion layer, wherein the silver halide emulsion contains a salt of a metal ion of which the atomic number is at least 21 or a mixture of a salt of a metal ion of which the atomic number is at least 21 and a chelating compound and wherein the silver halide emulsion has been chemically sensitized in the presence of a chemical sensitization promoter, the promoter comprising at least one of a silver halide solvent and an adsorbable compound.

DETAILED DESCRIPTION OF THE INVENTION

In the present invention, the chemically sensitized silver halide emulsion contains a salt of a metal ion of atomic number at least 21 or a mixture of a salt of a metal ion of atomic number at least 21 or a chelating agent; and, the silver halide emulsion has been chemically sensitized in the presence of a chemical sensitization promoter.

The addition of salts of metal ions such as Mg, Ca, Cd, Co, Mn, Zn and Hg, for example, to a silver halide emulsion for preventing the occurrence of fogging and for stabilization purposes is known, for example, in U.S. Pat. Nos. 2,839,405, 3,488,709 and 2,728,663.

However, the fact that salts of these metals of atomic number at least 21 inhibit the adverse effects of chemical stabilization promoters as in the present invention, and the fact that they improve the adsorption of sensitizing dyes and increase color sensitivity, is not taught or suggested in the prior art.

Furthermore, the fact that, as shown in the illustrative examples, mixtures of the salts of these metal ions and chelating agent have a more desirable action than the salts alone is not taught or suggested in the prior art.

Chemical sensitization promoters in the context of the present invention are silver halide solvents and adsorbable compounds.

Specific examples of silver halide solvents in the context of the present invention include thiocyanates (for example, potassium thiocyanate and ammonium thiocyanate), and (a) thioether compounds (for example, the compounds disclosed in U.S. Pat. Nos. 3,021,215 and 4,276,374, which are incorporated herein by reference) and (b) thione compounds (for example, the compounds disclosed in JP-B-59-11892, JP-B-60-11341 and U.S. Pat. No. 4,221,863, which are incorporated herein by reference). Specific examples of compounds of type (a) and (b) are listed below.

$$HO-(CH_2)_2S(CH_2)_2S(CH_2)_2OH \quad (a)$$

$$HO.CH_2\underset{\underset{OH}{|}}{C}HCH_2S(CH_2)_2SCH_2\underset{\underset{OH}{|}}{C}HCH_2OH$$

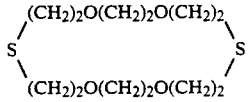

(b)

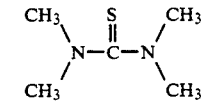

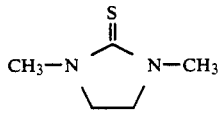

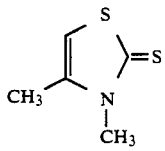

Of these compounds the thiocyanates are especially desirable.

The silver halide solvent should be added in sufficient amounts to be effective; and, in the case of the thiocyanates, they are preferably added in amounts of from $10^{-5}$ mol to $3\times10^{-1}$ mol, more preferably of from $1\times10^{-4}$ mol to $1\times10^{-1}$ mol, and most desirably of from $5\times10^{-4}$ mol to $1\times10^{-1}$ mol, per mol of silver halide in the emulsion layer to which they are added. The silver halide solvent is preferably added before the commencement of chemical ripening.

The term "adsorbable compound" in the context of the present invention means a compound capable of being adsorbed on the surface of silver halide grains. Suitable adsorbable compounds are include nitrogen-containing heterocyclic compounds capable of being adsorbed on the surface of silver halide grains, such as the compounds disclosed in *Research Disclosure,* volume 307, pages 866 and 869 (1989), which is incorporated herein by reference.

In more practical terms, the nitrogen containing heterocyclic ring of the adsorbable compound may be, for example, a pyrazole ring, a pyrimidine ring, a 1,2,4-triazole ring, a 1,2,3-triazole ring, a 1,3,4-thiadiazole ring, a 1,2,3-thiadiazole ring, a 1,2,4-thiadiazole ring, a 1,2,5-thiadiazole ring, a 1,2,3,4-tetrazole ring, a pyridazine ring, a 1,2,3-triazine ring, a 1,2,4-triazine ring, a 1,3,5-triazine ring, a benzotriazole ring, a benzimidazole ring, a benzothiazole ring, a quinoline ring, a benzoxazole ring, a benzoselenazole ring, a naphthothiazole ring, a naphthoimidazole ring, a rhodanine ring, a thiohydantoin ring, an oxazole ring, a thiazole ring, an oxadiazole ring, a selenadiazole ring, a naphthoxazole ring, an oxazolidinedione ring, a triazolotriazole ring, an azaindene ring (for example, a diazaindene ring, triazaindene ring, tetraazaindene ring, pentaazaindene ring), a phthalazine ring or an indazole ring.

Of these compounds, those which have an azaindene ring are preferred, and the azaindene compounds which have a hydroxy group as a substituent group, and the hydroxy-tetraazaindene compounds are especially desirable.

The adsorbable compound may have substituent groups other than the hydroxy group on the heterocyclic ring. For example, they may have alkyl groups, alkylthio groups, amino groups, hydroxyamino groups, alkylamino groups, dialkylamino groups, arylamino groups, carboxy groups, alkoxycarbonyl groups, halogen atoms, acylamino groups, cyano groups and mercapto groups, as substituent groups.

Specific examples of nitrogen containing heterocyclic compounds which can be used as the adsorbable compound in the present invention are listed below, but the invention is not limited to just these examples.

1. 4-Hydroxy-6-methyl-1,3,3a,7-tetraazaindene
2. 4-Hydroxy-6-tert-butyl-1,3,3a, 7-tetraazaindene
3. 4-Hydroxy-6-phenyl-1,3,3a,7-tetraazaindene
4. 4-Hydroxy-1,3,3a,7-tetraazaindene
5. 4-Methyl-6-hydroxy-1,3,3a,7-tetraazaindene
6. 2-Methylthio-4-hydroxy-6-methyl-1,3,3a, 7-tetraazaindene
7. 4-Hydroxy-5-bromo-6-methyl-1,3,3a, 7-tetraazaindene
8. 4-Hydroxy-6-methyl-1,2,3a,7-tetraazaindene
9. 4-Hydroxy-6-ethyl-1,2,3a-7-tetraazaindene
10. 2,4-Dihydroxy-6-phenyl-1,3a,7-triazaindene
11. 4-Hydroxy-6-phenyl-1,2,3,3a, 7-pentaazaindene
12. Adenine
13. Guanine
14. Benzotriazole
15. 5-Methylbenzotriazole
16. 5-Nitrobenzimidazole
17. 5-(m-Cyanophenyl)tetrazole
18. 1-Phenyl-5-mercaptotetrazole
19. 1-(m-Sulfophenyl)-5-mercaptotetrazole
20. 1-(3,5-Dicarboxyphenyl)-5-mercaptotetrazole
21. 1-Ethyl-5-mercaptotetrazole
22. 1-Methyl-2-mercapto-1,3,5-triazole
23. 1-Phenyl-2-mercaptoimidazole
24. 2-Mercapto-5-sulfobenziothiazole
25. 2-Mercapto-5-methylbenzimidazole
26. 1-Mercapto-3-methylthiothiadiazole
27. 2-Ethyl-3-methyl-$\beta$-naphthothiazolium p-toluenesulfonate The adsorbable compound should be sufficient added in amounts to be effective, and the compound is preferably added in an amount of from $10^{-5}$ mol to $10^{-1}$ mol, preferably of from $10^{-4}$ mol to $3\times10^{-2}$ mol, and most desirably of from $2\times10^{-4}$ mol to $10^{-2}$ mol, per mol of silver halide in the emulsion layer to which the compound is added. The addition may be made at any time from prior to commencement, during or upon completion of chemical ripening, but the compound is preferably added before the commencement of chemical ripening.

The metal ion of atomic number 21 or above is preferably a metal from the fourth to the sixth period of group VIII, VIIb, VIb, IVb, IIIb, IIb or Ib, and most desirably of groups VIII, VIIb, IIb or Ib.

In practice, Fe, Co, Ni, Ru, Pd, Os, Ir, Pt, Mn, Cu, Zn and Cd, for example, are preferred.

Suitable metal salts include halides (for example, chlorides), nitrates, sulfates or organic acid salts (for example, acetates) of the above metal ions. The salt of the metal ion should be dissolved in water, a lower alcohol, a lower cyano-hydrocarbon, ketone or a mixture of these solvents for addition to the silver halide emulsion.

The amount of the salt of the metal ion added is from $10^{-5}$ mol to 5 mol, preferably from $10^{-4}$ mol to 1 mol, and more preferable from $5\times10^{-4}$ mol to 0.5 mol, per mol of silver halide in the emulsion.

The chelating compound which is used in admixture with a salt of a metal ion of atomic number 21 or above in the context of the present invention includes compounds which have the ability to form complexes with metal ions.

In more practical terms, the chelating agent is an organic compound having a plurality of groups, which may be the same or different, which can form coordinate bonds with metal ions. Suitable groups include carboxyl groups, hydroxy groups, amino groups, including substituted amino groups, or phosphonic acid groups. Examples of suitable chelating agents include (a) polycarboxylic acids such as dicarboxylic acids and tricarboxylic acids, (b) oxycarboxylic acids, (c) amines, (d) aminocarboxylic acids and (e) aminophosphonic acids. From among these, (a), (b), (d) and (e) are preferred, and (a), (b) and (d) are especially desirable.

Specific examples of suitable chelating agents are listed below.

(a-1): Oxalic acid
(a-2): Malonic acid
(a-3): Succinic acid
(a-4): Maleic acid
(a-5): Phthalic acid
(a-6): Itaconic acid
(b-1): Tartaric acid
(b-2): Citric acid
(b-3): Malic acid
(b-4): Glutaric acid
(b-5): Salicylic acid
(c-1): Ethylenediamine
(c-2): Diethylenetriamine
(c-3): Trimethylenediamine
(c-4): Phenanthroline
(d-1): Alanine
(d-2): Aspartic acid
(d-3): Glycine
(d-4): Glutamic acid
(d-5): Iminodiacetic acid
(d-6): N-Methyliminodiacetic acid
(d-7): Nitrilotriacetic acid
(d-8): Anilinediacetic acid
(d-9): Ethylenediamine-N,N'-diacetic acid
(d-10): Ethylenediaminetetraacetic acid
(d-11): Diethylenetriaminepentaacetic acid
(d-12): Cyclohexanediaminetetraacetic acid
(d-13): Hydroxyethyliminodiacetic acid
(e-1): Ethylenediaminetetramethylenephosphonic acid
(e-2): Diethylenetriaminepentamethylenephosphonic acid
(e-3): Cyclohexanediaminetetramethylenephosphonic acid
(e-4): Nitrilotrimethylenephosphonic acid The mixtures of salts of metal ions and chelating compounds in the context of this present invention include mixtures of the above chelating agents and the metal salts mentioned earlier. The mixture is suitably dissolved in water, lower alcohol, lower cyano-hydrocarbon, ketone or a mixture of these solvents for addition to the emulsion. Water is the preferred solvent.

The mixing ratio of the metal salt and the chelating agent is not particularly limited, but it is preferably within the range from 1:10 to 10:1, and preferably within the range from 1:3 to 3:1, by mol, and the amount added as metal ion is from $10^{-5}$ mol to 5 mol, preferably from $10^{-4}$ mol to 1 mol, and most desirably from $5\times10^{-4}$ mol to 0.5 mol, per mol of silver halide in the emulsion.

The salt of a metal ion of which the atomic number is at least 21 can be used alone, or mixture of such a salt of a metal ion with a chelating agent can be used in accordance with the present invention. The use of a mixture of a salt of a metal ion and a chelating agent is preferred.

The time of the addition of the metal salt or of the mixture of a salt of metal ion and chelating agent can be selected appropriately by one of ordinary skill in the art according to the silver halide emulsion in which they are being used, but the addition is preferably made during the period extending from after the completion of chemical ripening until immediately before coating, and addition immediately after chemical ripening is most desirable. Furthermore, in those cases where sensitizing dyes are added, the addition is preferably made before the addition of these dyes.

The silver halide emulsions used in the present invention are preferably spectrally sensitized with methine dyes or by other means. The dyes which can be used include cyanine dyes, merocyanine dyes, complex cyanine dyes, complex merocyanine dyes, holopolar cyanine dyes, hemicyanine dyes, styryl dyes and hemioxonol dyes. Dyes classified as cyanine dyes, merocyanine dyes and complex merocyanine dyes are especially useful. All of the nuclei generally used in cyanine dyes can be used for the basic heterocyclic nuclei in these dyes. The nucleus may be a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus or a pyridine nucleus; a nucleus in which one of these nuclei is fused with an aliphatic hydrocarbyl ring, or a nucleus in which one of these nuclei is fused with an aromatic hydrocarbyl ring, for example, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus or a quinoline nucleus. These nuclei may be substituted on carbon atoms.

The nuclei which have a ketomethylene structure in the merocyanine dyes or complex merocyanine dyes may be five-or six-membered heterocyclic nuclei, for example, a pyrazolin-5-one nucleus, a thiohydantoin nucleus, a 2-thio-oxazolidin-2, 4-dione nucleus, a thiazolidin-2,4-dione nucleus, a rhodanine nucleus or a thiobarbituric acid nucleus.

For example, the compounds disclosed in *Research Disclosure* Item 17643, page 23, section IV (December 1978) or the compounds disclosed in the literature cited therein can be used.

The amount added may be from $4\times10^{-6}$ to $8\times10^{-3}$ mol per mol of silver halide, but in the case of a preferred silver halide grain size of from 0.2 to 1.2 $\mu$, amounts of from about $5\times10^{-5}$ to $2\times10^{-3}$ mol are more effective.

Preferred embodiments of the silver halide emulsion useful in the present invention are described below.

(1) A silver halide emulsion which contains a mixture of a salt of a metal ion of which the atomic number is at least 21 and a chelating agent and which has been chemically sensitized using a silver halide solvent as a chemical sensitization promoter, most desirably a thiocyanate.

(2) A silver halide emulsion which contains a salt of a metal ion of which the atomic number is at least 21, and which has been chemically sensitized using a silver halide solvent as a chemical sensitization promoter, preferably a thiocyanate.

(3) A silver halide emulsion which contains a mixture of a salt of a metal ion of which the atomic number is at least 21 and a chelating agent, and which has been chemically sensitized using an adsorbable compound as a chemical sensitization promoter, preferably an azaindene, azapyrimidine, purine or azapyridazine, and most desirably 4-hydroxy-6-methyl-1, 3,3a,7-tetraazaindene.

(4) A silver halide emulsion which contains a salt of a metal ion of which the atomic number is at least 21, and which has been chemically sensitized using an adsorbable compound as chemical sensitization promoter, preferably an azaindene, azapyrimidine, purine or azapyridazine, and most desirably 4-hydroxy-6-methyl-1,3,3a,7-tetraazaindene.

(5) An emulsion wherein the metal ion in (1), (2), (3) or (4) above is preferably the ion of a metal of group VIII, group VIIb, group Ib or group IIb, and most desirably the ion of a metal of group VIII.

(6) An emulsion as described in (1), (2), (3) or (4) which has been spectrally sensitized with a methine based dye.

(7) An emulsion wherein the chelating agent in (1) or (3) above is a polycarboxylic acid, an oxycarboxylic acid, an aminocarboxylic acid or an aminophosphonic acid.

In the present invention, silver bromide, silver iodobromide, silver iodochlorobromide, silver chlorobromide, silver iodide and silver chloride can all be used as the silver halide in the photographic emulsion.

The grain size distribution may be narrow or wide.

The silver halide grains in the photographic emulsion may have a regular crystalline form such as a cubic, octahedral, tetradecahedral or rhombo-dodecahedral form, or they may have an irregular crystalline form such as a spherical or tabular form, or they may have a form which is a composite of these crystalline forms. They may also be comprised of a mixture of grains which have various crystalline forms.

The silver halide grains may be such that the interior part and the surface layer are comprised of different phases, or they may be comprised of a uniform phase.

Furthermore, they may be, for example, junction type silver halide crystals in which oxide crystals such as PbO and silver halide crystals such as silver chloride are bonded together, silver halide crystals which have been grown epitaxially (for example, with silver chloride, silver iodobromide or silver iodide, for example, grown epitaxially on silver bromide), or complex crystals in which a silver chloride which has a regular hexagonal form is orientated on a silver iodide which has a hexagonal crystal form.

Furthermore, the grain size distribution of the silver halide grains in the photographic emulsion is not particularly limited, but it may be of a monodispersion. Here, a monodispersion signifies a dispersion in which 95% of the grains are of a size within ±60%, and preferably within ±40%, of the number average grain size. Here, the number average grain size signifies the number average diameter of the projected areas of the silver halide grains.

The photographic emulsions in this present invention can be prepared using the methods described, for example, by P. Glafkides in *Chimie et Physique Photographique*, published by Paul Montel, 1967, by G. F. Duffin in *Photographic Emulsion Chemistry*, published by Focal Press, 1966, and by V. L. Zelikmann et al. in *Making and Coating Photographic Emulsions*, published by Focal Press, 1964. That is to say, they may be prepared using acidic methods, neutral methods or ammonia methods for example, and the single-jet method, the double-jet method or a combination of these methods can be used for the system by which the soluble silver salt is reacted with the soluble halogen salt.

Procedures (so-called reverse mixing methods) in which grains are formed in the presence of excess silver ion can also be used. The method in which the pAg value in the liquid phase in which the silver halide is being formed is held constant, the so-called controlled double-jet method, can also be used as one type of the double-jet methods.

Silver halide emulsions which have a regular crystalline form and an almost uniform grain size are obtained when this method is used.

Mixtures of two or more silver halide emulsions which have been formed separately may be used.

Cadmium salts, zinc salts, lead salts, thallium salts, iridium salts or complex salts thereof, rhodium salts or complex salts thereof, and iron salts or complex salts thereof, for example, may be present during the formation or physical ripening processes of the silver halide grains. Furthermore, these can be added in small amounts or large amounts according to the photosensitive material intended.

The noodle washing method in which the gelatin is gelled may be used to remove the soluble salts from the emulsion after precipitation and formation or after physical ripening, or sedimentation methods (flocculation methods) in which inorganic salts, anionic surfactants, anionic polymers (for example, poly(styrenesulfonic acid)) or gelatin derivatives (for example, acylated gelatin or carbamoylated gelatin) are used, can be used for this purpose.

The silver halide emulsions which have been prepared in accordance with this present invention can be used in both color photographic photosensitive materials and black and white photosensitive materials.

The color photographic photosensitive materials include, in particular, color papers, films for color photography and color reversal films, and the black and white materials include films for X-ray purposes, general purpose camera films and films for use as sensitive materials for printing applications.

No particular limitation is imposed upon the other additives in the photographic photosensitive materials in which emulsions of the present invention are used, and reference can be made in this connection with the disclosures made, for example, in *Research Disclosure* volume 176, item 17643 (RD 17643) and *Research Disclosure* volume 187, item 18716 (RD 18716), which are incorporated herein by reference.

The locations of the disclosures concerning each type of additive in RD 17643 and RD 18716 are itemized below.

| | Type of Additive | RD 17643 | RD 18716 |
|---|---|---|---|
| 1. | Chemical sensitizers | Page 23 | Page 648, right col. |
| 2. | Speed increasing agents | | As above |
| 3. | Spectral sensitizers and Supersensitizers | Pages 23-24 | Pages 648 right col. to 649 right col. |
| 4. | Whiteners | Page 24 | |
| 5. | Antifoggants and stabilizers | Pages 24-25 | Pages 649, right col. |
| 6. | Light absorbers filter dye and UV absorber's | Pages 25-26 | Pages 649, right col. to 650, left col. |
| 7. | Antistaining agents | Page 25, right col. | Page 650, left col. to right col. |
| 8. | Dye image stabilizers | Page 25 | |
| 9. | Film hardening agents | Page 26 | Page 651, left col. |
| 10. | Binders | Page 26 | As above |
| 11. | Plasticizers, lubricants | Page 27 | Page 650, right col. |
| 12. | Coating promoters, Surfactants | Pages 26-27 | As above |
| 13. | Antistatic agents | Page 27 | As above |

EXAMPLES

Illustrative examples of the present invention are outlined below, which, however, are not intended to limit the scope of the present invention in any manner.

EXAMPLE 1 Use of an Adsorbable Compound as a Chemical Sensitization Promoter After adding ammonia, an aqueous solution of silver nitrate and an aqueous mixed solution of potassium bromide and potassium iodide were added simultaneously to an aqueous gelatin solution which contained potassium bromide which was being maintained at 75° C. and agitated thoroughly, and a core emulsion was formed.

This emulsion was neutralized with acid, after which an aqueous solution of silver nitrate and an aqueous solution of potassium bromide were added simultaneously and a shell part was attached.

Next, after washing with water and desalting using the flocculation method in the usual way, gelatin was added and the pH and pAg values were adjusted to 6.4 and 8.7, respectively.

A monodispersed octahedral silver iodobromide emulsion of average grain size about 0.8 $\mu$ which had a double layer structure of average iodide content 7 mol. % with a high iodide content (21 mol. %) in the core part was obtained in this way.

This emulsion was divided into two parts. Sodium thiosulfate (4.8 mg) and 4.1 mg of chloroauric acid were added successively per mol of silver halide to one part and the emulsion was ripened for 60 minutes at 60° C. to provide emulsion (A). 4-Hydroxy-6-methyl-1,3,3a,7-tetraazaindene (0.45 gram) (adsorbable compound 1 of this present invention, referred to hereinafter as TAI) was added to the other part as a chemical sensitization promoter and, after 20 minutes, 12 mg of sodium thiosulfate and 4.1 mg of chloroauric acid were added successively and the emulsion was ripened for 60 minutes to provide emulsion (B).

TAI was added at the rate of 0.45 gram per mol of silver halide to part of emulsion (A), and then to this emulsion and part of emulsion (B) as prepared were added the coupler, gelatin hardening agent and coating promoter described hereinafter and the emulsions were coated along with a gelatin protective layer at the same time onto cellulose acetate film supports and Samples 1 and 2 which had not been color sensitized were obtained.

Next, emulsion (B) was subdivided and melted at 40° C. and compounds dissolved in water as shown in Table 2, per mol of silver halide, were added.

The sensitizing dye 5-chloro-5'-phenyl-3, 3'-di($\gamma$-sulfopropyl)-9-ethyl-oxacarbocyanine, sodium salt (0.34 g/mol.Ag) was added to each of these emulsions (B) and emulsion (A), the same coupler, gelatin hardening agent and coating promoter as in Samples 1 and 2 were added and the emulsions were coated to provide color sensitized Samples 3 to 24.

Samples 1 and 2 were exposed through a 419 nm interference filter and an optical wedge, and Samples 3 to 24 were exposed through a 550 nm interference filter and an optical wedge, using a 1/100th second exposure in each case, and then the samples were subjected to color development processing as outlined below.

| Development Processing | |
|---|---|
| 1. Color Development | 2 minutes 45 seconds (38° C.) |
| 2. Bleaching | 6 minutes 30 seconds |
| 3. Water Washing | 3 minutes 15 seconds |
| 4. Fixing | 6 minutes 30 seconds |
| 5. Water Washing | 3 minutes 15 seconds |
| 6. Stabilization | 3 minutes 15 seconds |

The compositions of the processing baths used for each process were as indicated below.

| | |
|---|---|
| Color Developer | |
| Nitrilotriacetic acid, sodium salt | 1.0 gram |
| Sodium sulfite | 4.0 grams |
| Sodium carbonate | 30.0 grams |
| Potassium bromide | 1.4 grams |
| Hydroxylamine sulfate | 2.4 grams |
| 4-(N-Ethyl-N-$\beta$-hydroxyethylamino)-2-methylaniline sulfate | 4.5 grams |
| Water to make | 1 liter |
| Bleach | |
| Ammonium bromide | 160.0 grams |
| Aqueous ammonia (28%) | 25.0 ml |
| Ethylenediaminetetraacetic acid, sodium ferric salt | 130 grams |
| Glacial acetic acid | 14 ml |
| Water to make | 1 liter |
| Fixer | |
| Sodium tetrapolyphosphate | 2.0 grams |
| Sodium sulfite | 4.0 grams |
| Ammonium thiosulfate (70%) | 175.0 ml |
| Sodium bisulfite | 4.6 grams |
| Water to make | 1 liter |
| Stabilizer | |
| Formalin | 8.0 ml |
| Water to make | 1 liter |
| Additives Added | |
| Coupler: | 1-(2,4,6-Trichlorophenyl)-3-[3-(2,4- |

-continued

| | |
|---|---|
| | di-tert-amylphenoxy)-acetamido]-benzamido-5-pyrazolone |
| Gelatin Hardening Agent: | 2,4-Dichloro-6-hydroxy-s-triazine, sodium salt. |
| Coating Promoter: | Sodium dodecylbenzenesulfonate |

The results obtained were as shown in Tables 1 and 2.

Moreover, the relative speed is represented as the relative value of the reciprocal of the exposure required to obtain an optical density of fog+0.2, and in Table 1 the speed for Sample 1 was taken to be 100 while in Table 2 the value for Sample 3 was taken to be 100.

Furthermore, the absorbance at 550 nm of the coated film measured using a spectrophotometer in which a sphere of integration was used is shown in Table 2 in order to indicate the degree of adsorption of the dye. 550 nm corresponds to the absorption peak of J-aggregates of the said dye on silver halide.

TABLE 1

| Sample No. | Emulsion | Relative Speed at 419 nm | Fog |
|---|---|---|---|
| 1 | A | 10 | 0.25 |
| 2 | B | 151 | 0.18 |

TABLE 2

| Sample Number | Emulsion | Metal Salt, mmol/mol · Ag | | Chelating Compound, mmol/mol · Ag | Method of Addition | Relative Speed at 550 nm | Absorbance at 550 nm (%) | |
|---|---|---|---|---|---|---|---|---|
| 3 | (A) | — | | — | | 100 | 72 | Comparative Example |
| 4 | " | $Ni(NO_3)_2$ | 80 | (b-1) 80 | *1 | 100 | 72 | Comparative Example |
| 5 | (B) | — | | — | | 45 | 20 | Comparative Example |
| 6 | " | $Ca(NO_3)_2$ | 80 | — | | 48 | 22 | Comparative Example |
| 7 | " | $Ni(NO_3)_2$ | 80 | — | | 125 | 44 | This Invention |
| 8 | " | $CoSO_4$ | 80 | — | | 120 | 41 | This Invention |
| 9 | " | $Zn(NO_3)_2$ | 80 | — | | 118 | 39 | This Invention |
| 10 | " | — | | (b-1) 80 | | 45 | 20 | Comparative Example |
| 11 | " | — | | (d-5) 80 | | 45 | 20 | Comparative Example |
| 12 | " | $Ni(NO_3)_2$ | 40 | (d-1) 40 | *1 | 165 | 55 | This Invention |
| 13 | (B) | $Ni(NO_3)_2$ | 40 | (d-1) 40 | *2 | 162 | 54 | This Invention |
| 14 | " | " | 60 | (d-7) 80 | *1 | 140 | 48 | This Invention |
| 15 | " | " | 60 | (d-10) 80 | *1 | 158 | 52 | This Invention |
| 16 | " | " | 40 | (d-3) 80 | *1 | 135 | 46 | This Invention |
| 17 | " | " | 30 | (a-3) 60 | *1 | 130 | 42 | This Invention |
| 18 | " | " | 30 | (e-4) 60 | *1 | 150 | 52 | This Invention |
| 19 | " | " | 80 | (d-5) 80 | *1 | 162 | 54 | This Invention |
| 20 | " | $CoSO_4$ | 40 | (d-5) 80 | *1 | 132 | 43 | This Invention |
| 21 | " | $Zn(NO_3)_2$ | 60 | (d-5) 60 | *1 | 128 | 42 | This Invention |
| 22 | " | " | 60 | (b-2) 60 | *1 | 128 | 42 | This Invention |
| 23 | " | $Cu(NO_3)_2$ | 40 | (d-7) 80 | *1 | 138 | 48 | This Invention |
| 24 | " | $MnSO_4$ | 80 | (d-5) 80 | *1 | 122 | 41 | This Invention |

In those cases where a metal ion and a chelating agent mixture were involved in Table 2, *1 indicates that the two components were mixed in water beforehand and then added to the silver halide emulsion, and *2 indicates that the two components were added separately and successively to the silver halide emulsion. There was no great difference between these two procedures, but better results were obtained with premixing.

It is clear from Table 1 that when the chemical sensitizing promoter TAI was used at the time of chemical sensitization the intrinsic photographic speed of the silver halide emulsion was raised when no sensitizing dye was used, as was known already, and fogging was also inhibited.

However, as shown in Table 2, when a sensitizing dye was added for spectral sensitization, emulsion (B) contained residual TAI which had been used during chemical sensitization and so there was a pronounced adverse effect on dye adsorption (this is clear from the fact that the absorbance is low), and the photographic speed was markedly reduced (Sample 5).

There was not much improvement when a salt of Ca, which has an atomic number of 20, or a chelating agent (Samples 6, 10, 11) was added to this emulsion.

However, when metal salts in which the metal had a higher atomic number were added, the color sensitized photographic speed was increased; and, when a chelating agent was added as well, depending on the particular case, an increase in color sensitized speed greater than the sensitization increase in Table 1 was obtained. This was because the interference with the adsorption of dye due to the TAI was reduced, as is clear from the absorbances.

Thus, good dye adsorption is achieved even when adsorbable compounds are used as chemical sensitization promoters in this present invention, and silver halide emulsions which have a high color sensitized photographic speed can be obtained.

EXAMPLE 2 Use of Silver Halide Solvents as Chemical Sensitization Promoters

An aqueous solution of silver nitrate and an aqueous solution of potassium bromide were added simultaneously to an aqueous solution of gelatin which contained potassium bromide and which was being maintained at 30° C. Subsequently, the temperature was raised to 75° C. and gelatin was added, after which an aqueous silver nitrate solution and an aqueous potassium bromide solution were further added. In addition, 3,6-dithia-1,8-octanediol was added and then an aqueous silver nitrate solution and an aqueous solution of potassium bromide and potassium iodide were added simultaneously and then the emulsion was washed with water and desalted using the flocculation method, after which gelatin was added and the pH and pAg values were adjusted to 6.5 and 8.6, respectively. The resulting silver iodobromide emulsion was comprised of tabular grains of average iodide content 2.5 mol. % of which the core part was comprised of silver bromide and the outer spherical part contained 7.5 mol. % of silver iodide, and the average corresponding circle grain size was 1.8 μ and the grain thickness was 0.25 μ.

This emulsion was divided into three parts, and emulsion (C) was prepared by adding 4.0 mg of sodium thiosulfate and 5.7 mg of chloroauric acid successively per mol of silver halide and ripening for 60 minutes at 60° C., emulsion (D) was prepared by further adding the sodium thiosulfate and chloroauric acid and adding 49 mg of potassium thiocyanate, a silver halide solvent, as a chemical sensitization promoter, and emulsion (E) was prepared with the amount of potassium thiocyanate increased to 490 mg.

Each of these emulsions was subdivided and compounds were added as shown in Tables 3 and 4, per mol of silver halide. The mixtures of the salts of the metal ions and chelating agents were used after premixing in aqueous solution in all cases:

4-Hydroxy-6-methyl-1,3,3a,7-tetraazaindene (stabilizer, 0.75 gram), 0.05 gram of 1-(m-sulfophenyl)-5-mercaptotetrazole (antifogging agent) and the same gelatin hardening agent and coating promoter as in Example 1 were added to each emulsion and the emulsions were coated, together with a gelatin protective layer, onto poly(ethylene terephthalate) film supports to provide Samples 30 to 41.

Furthermore, a sensitizing dye, 5,5'-dichloro-3, 3'-di(γ-sulfopropyl)-9-ethyl-thiocarbocyanine, sodium salt, (0.44 gram/mol.Ag) was added to each emulsion and then the above mentioned stabilizer, antifogging agent, gelatin hardening agent and coating promoter were added to provide color sensitized Samples 42 to 55.

The coated Samples 30 to 41 were exposed (1/100th second) through a 419 nm interference filter and an optical wedge and Samples 42 to 55 were exposed (1/100th second) through a 651 nm interference filter and an optical wedge, and then the samples were developed for 20 seconds at 35° C. and fixed using developer RD-III for use in automatic processors (made by Fuji Photographic Film Co., Ltd.) and washed and dried in the usual way, and the photographic speeds were measured. Photographic speed is represented by the relative value of the reciprocal of the exposure required to provide an optical density of fog+0.2, and in Table 3 the intrinsic speed at 419 nm for Sample 30 immediately after coating is taken to be 100, and in Table 4 the photographic speed in the spectral region of 651 nm immediately after coating of Sample 42 was taken to be 100.

Furthermore, the same development processing was carried out after ageing the samples for 35 days after coating.

TABLE 3

| Sample Number | Emulsion | Metal Salt (mmol/mol · Ag) | | Chelating Agent (mmol/mol · Ag) | Relative Speed at 419 nm Immediately After Coating | Relative Speed at 419 nm After Ageing for 35 Days | |
|---|---|---|---|---|---|---|---|
| 30 | C | — | | — | 100 | 100 | Comparative Example |
| 31 | C | $CoSO_4$ | 80 | (d-5) 80 | 100 | 100 | Comparative Example |
| 32 | D | — | | — | 108 | 98 | Comparative Example |
| 33 | D | $CoSO_4$ | 80 | (d-5) 80 | 108 | 106 | This Invention |
| 34 | E | — | | — | 144 | 114 | Comparative Example |
| 35 | E | $Ca(NO_3)_2$ | 80 | (d-5) 80 | 144 | 114 | Comparative Example |
| 36 | E | $CoSO_4$ | 80 | — | 144 | 138 | This Invention |
| 37 | E | $Ni(NO_3)_2$ | 80 | — | 144 | 135 | This Invention |
| 38 | E | $Ni(NO_3)_2$ | 80 | (d-5) 80 | 144 | 140 | This Invention |
| 39 | E | $CoSO_4$ | 80 | (d-5) 80 | 144 | 142 | This Invention |
| 40 | E | $Zn(NO_3)_2$ | 40 | (d-7) 80 | 144 | 140 | This Invention |
| 41 | E | $MnSO_4$ | 40 | (b-2) 80 | 144 | 140 | This Invention |

TABLE 4

| Sample Number | Emulsion | Metal Salt (mmol/mol · Ag) | | Chelating Agent (mmol/mol · Ag) | Relative Speed at 651 nm Immediately After Coating | Relative Speed at 651 nm After Ageing for 35 Days | |
|---|---|---|---|---|---|---|---|
| 42 | C | — | | — | 100 | 94 | Comparative Example |
| 43 | C | $Ni(NO_3)_2$ | 60 | (d-5) 80 | 100 | 94 | Comparative Example |
| 44 | D | — | | — | 110 | 98 | Comparative Example |
| 45 | D | $Ni(NO_3)_2$ | 60 | (d-5) 80 | 110 | 104 | This Invention |
| 46 | E | — | | — | 224 | 126 | Comparative Example |
| 47 | E | $Ca(NO_3)_2$ | 60 | (d-5) 80 | 224 | 128 | Comparative Example |
| 48 | E | $Ni(NO_3)_2$ | 60 | — | 224 | 185 | This Invention |
| 49 | E | $CoSO_4$ | 60 | — | 224 | 190 | This Invention |
| 50 | E | $Ni(NO_3)_2$ | 80 | (d-5) 120 | 224 | 205 | This Invention |
| 51 | E | " | 80 | (d-7) 120 | 224 | 205 | This Invention |
| 52 | E | $Zn(NO_3)_2$ | 80 | (d-5) 120 | 222 | 200 | This Invention |
| 53 | E | $CoSO_4$ | 80 | (d-5) 80 | 222 | 210 | This Invention |
| 54 | E | " | 80 | (e-4) 80 | 224 | 202 | This Invention |
| 55 | E | $MnSO_4$ | 60 | (b-2) 120 | 220 | 195 | This Invention |

It is clear from Table 3 that emulsion (E), in which a large amount of potassium thiocyanate chemical sensitization promoter had been used, had a high photographic speed immediately after coating but that the photographic speed decreased rapidly on ageing. The same trend, though to a lesser extent, was seen with emulsion (D).

There was virtually no improvement when a salt of a metal ion which had a low atomic number and chelating agent were added, but there was a marked improvement when the salts of the metal ions of this present invention which had a higher atomic number, alone or together with the chelating agents were added.

Furthermore, as shown in Table 4, the effect was more pronounced with emulsion (E) in which a large amount of chemical sensitization promoter potassium thiocyanate had been used and an increase in photographic speed greater than the increase shown in Table 3 was obtained with spectral sensitization using a dye together with the use of a thiocyanate.

However, under these conditions the speed inevitably decreased rapidly (more than in Table 3) on ageing. However, there was a marked improvement on adding the compounds of this present invention.

Thus, storage properties were improved by means of this present invention even when large amounts of silver halide solvent had been used as chemical sensitization promoters, and silver halide photosensitive materials which had a high color sensitized photographic speed were obtained.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having thereon at least one silver halide emulsion layer wherein the silver halide emulsion contains a salt of a metal ion, said metal ion being selected from the group consisting of metallic ions of Co, Ni, Ru, Pd, Pt, Mn, Cu, or Zn, alone or together with a chelating compound, wherein the silver halide emulsion has been chemically sensitized in the presence of a chemical sensitization promoter comprising at least one of a silver halide solvent and an adsorbable compound, and wherein said salt of a metal ion is added to said emulsion during the period extending from after completion of chemical ripening until immediately before coating.

2. A silver halide photosensitive material as claimed in claim 1 wherein the salt is selected from the group consisting of halides, nitrates, sulfates, and organic acid salts.

3. A silver halide photosensitive material as claimed in claim 1 wherein the metal salt is present in an amount of from $1\times10^{-5}$ to 5 mole per mole of silver halide.

4. A silver halide photosensitive material as claimed in claim 1 wherein the metal salt is present in an amount of from $5\times10^{-4}$ to 0.5 mole per mole of silver halide.

5. A silver halide photosensitive material as claimed in claim 1 wherein the chelating agent is selected from the group consisting of polycarboxylic acids, oxycarboxylic acids, aminocarboxylic acids, aminophosphonic acids and amines.

6. A silver halide photosensitive material as claimed in claim 1 wherein the chelating agent is selected from the group consisting of polycarboxylic, oxycarboxylic, aminocarboxylic, and aminophosphonic acids.

7. A silver halide photosensitive material as claimed in claim 1 wherein the emulsion has been spectrally sensitized with a methine based dye.

8. A silver halide photosensitive material as claimed in claim 1 wherein the emulsion has been spectrally sensitized with a cyanine, merocyanine, or complex merocyanine dye.

9. A silver halide photosensitive material as claimed in claim 7 wherein the dye is present in a concentration of $4 \times 10^{-6}$ to $8 \times 10^{-3}$ mole per mole of silver halide.

10. A silver halide photosensitive material as claimed in claim 1 wherein the silver halide solvent is selected from the group consisting of thiocyanates, thioethers, and thiones.

11. A silver halide photosensitive material as claimed in claim 1 wherein the silver halide solvent is thiocyanate.

12. A silver halide photosensitive material as claimed in claim 1 wherein the silver halide solvent is present in a concentration of $1 \times 10^{-5}$ to $3 \times 10^{-1}$ mole per mole of silver halide.

13. A silver halide photosensitive material as claimed in claim 1 wherein the adsorbable compound is selected from nitrogen-containing heterocyclic compounds capable of being adsorbed on the surface of silver halide grains.

14. A silver halide photosensitive material as claimed in claim 1 wherein the adsorbable compound is selected from the group consisting of azaindenes, azapyrimidines, purines and azapyridazines.

15. A silver halide photosensitive material as claimed in claim 1 wherein the adsorbable compound is 4-hydroxy-6-methyl-1,3,3a,7-tetra-azaindene.

16. A silver halide photosensitive material as claimed in claim 1 wherein the adsorbable compound is present in a concentration of $10^{-5}$ to $10^{-1}$ mole per mole of silver halide.

17. A silver halide photographic material as claimed in claim 1 wherein the molar ratio of the concentrations of the metal salt to the chelating agent is from 1:3 to 3:1.

* * * * *